US005983864A

United States Patent [19]

Chockley et al.

[11] Patent Number: 5,983,864

[45] Date of Patent: Nov. 16, 1999

[54] JUMPER TUBE WITH IMPROVED MISALIGNMENT CAPABILITY

[75] Inventors: Scott A. Chockley, Williamsfield; Dennis H. Gibson; Gregory W. Hefler, both of Chillicothe; Ronald D. Shinogle, Peoria; Alan R. Stockner, Metamora, all of Ill.

[73] Assignee: Caterpillar Inc., Peoria, Ill.

[21] Appl. No.: 08/996,888

[22] Filed: Dec. 23, 1997

[51] Int. Cl.[6] ..... F02M 37/04

[52] U.S. Cl. ..... 123/470; 123/468

[58] Field of Search ..... 123/468, 470, 123/469, 509; 285/133.11, 133.21, 133.5

[56] References Cited

U.S. PATENT DOCUMENTS

| | | | |
|---|---|---|---|
| 3,638,972 | 2/1972 | Alpine | 285/156 |
| 3,924,583 | 12/1975 | Jardin | 123/32 JV |
| 3,930,483 | 1/1976 | Blisko et al. | 123/139 AW |
| 4,213,564 | 7/1980 | Hulsing | 239/88 |
| 4,315,603 | 2/1982 | Nakajima et al. | 239/533.3 |
| 4,693,223 | 9/1987 | Eshleman et al. | 123/468 |
| 4,858,964 | 8/1989 | Usui | 285/156 |
| 4,938,193 | 7/1990 | Raufeisen | 123/470 |
| 5,046,765 | 9/1991 | Usui | 285/197 |
| 5,297,523 | 3/1994 | Hafner | 123/468 |
| 5,365,907 | 11/1994 | Dietrich | 123/470 |
| 5,499,612 | 3/1996 | Haughney et al. | 123/470 |
| 5,730,101 | 3/1998 | Aupperle | 123/470 |
| 5,775,303 | 7/1998 | Sweetland | 123/470 |
| 5,799,986 | 9/1998 | Corbett | 285/55 |
| 5,806,494 | 9/1998 | Glassey | 123/470 |
| 5,870,995 | 2/1999 | Stockner | 123/470 |

FOREIGN PATENT DOCUMENTS

| | | | |
|---|---|---|---|
| 4319269 | 12/1994 | Germany | 123/469 |
| 2024324A | 1/1980 | United Kingdom | F02M 55/00 |
| 2320284A | 6/1998 | United Kingdom | F02M 55/02 |
| 97/25530 | 7/1997 | WIPO | F02M 39/02 |

*Primary Examiner*—Carl S. Miller

[57] ABSTRACT

A jumper tube with improved misalignment capability comprising a cylindrically shaped receiver portion having a central bore that receives an electronically controlled hydraulically actuated unit fuel injector, an annular groove disposed adjacent each end of the bore, a resilient seal ring disposed in each annular groove, forming a seal between the injector and the bore and providing three degrees of freedom between the injector and bore, a tubular portion having an elongated passage in fluid communication with the bore and a conduit in fluid communication with an actuating fluid manifold and the elongated passage and a bolt extending through the tubular portion, the conduit portion and a portion of the actuating fluid manifold removably attaching the jumper tube to a head of an internal combustion engine.

4 Claims, 2 Drawing Sheets

JUMPER TUBE WITH IMPROVED MISALIGNMENT CAPABILITY

TECHNICAL FIELD

The invention relates to a jumper tube and more particularly to a jumper tube that provides for misalignment of an electronically controlled hydraulically operated unit fuel injector installed in an internal combustion engine.

BACKGROUND ART

Jumper tubes are conduits bringing high pressure actuating fluid or oil from a supply manifold to the injectors. The jumper tubes are normally rigidly attached to the injectors allowing very little misalignment and may cause distortion within the injectors that have parts that move rapidly under high pressure with tight clearances. U.S. Pat. No. 5,499,612 shows such a conduit rigidly connected to a hydraulically operated injector by a bolted flange or retainer plate.

DISCLOSURE OF THE INVENTION

Among the objects of this invention may be noted the provision of a jumper tube that will allow for misalignment without distorting the injector.

In general, a jumper tube for an electronically controlled hydraulically operated unit fuel injector having an activating fluid inlet port disposed therein. The injector is disposed in a head of an internal combustion engine to inject fuel into an associated cylinder. An activating fluid supply manifold is also disposed in the head. When made in accordance with this invention the jumper tube comprises a receiver portion having a central bore which receives the injector and an annular groove adjacent each end of the bore, a resilient seal ring so disposed in each of the annular grooves to form a seal adjacent each end of the bore between the injector and the bore and to allow three degrees of freedom between the receiver portion and the injector eliminating any distortion of the injector due to misalignment. The jumper tube also comprises a conduit providing fluid communication between the bore and the activating fluid supply manifold and the inlet port of the injector.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
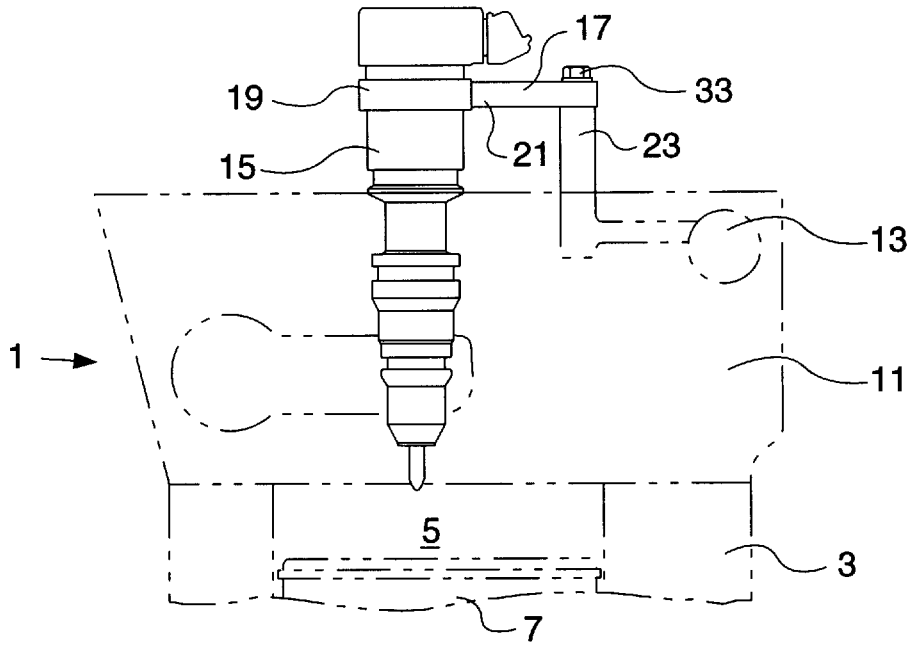
FIG. 1 is an elevational view of an injector and a jumper tube with portions of an internal combustion engine shown in phantom.

Referring now to the drawings in detail and in particular to FIG. 1, there is shown a portion of an internal combustion engine 1 comprising a block 3 having a plurality of cylinders 5 (only one being shown) with a piston 7 disposed therein. A portion of a head 11 is also shown in phantom and has a high pressure working or actuating fluid supply manifold 13 for operating an electronically controlled hydraulically actuated unit fuel injector 15. A jumper tube 17 places an activating fluid inlet port 18 in the fuel injector 15 in fluid communication with the actuating fluid supply manifold 13.

Figure 2:
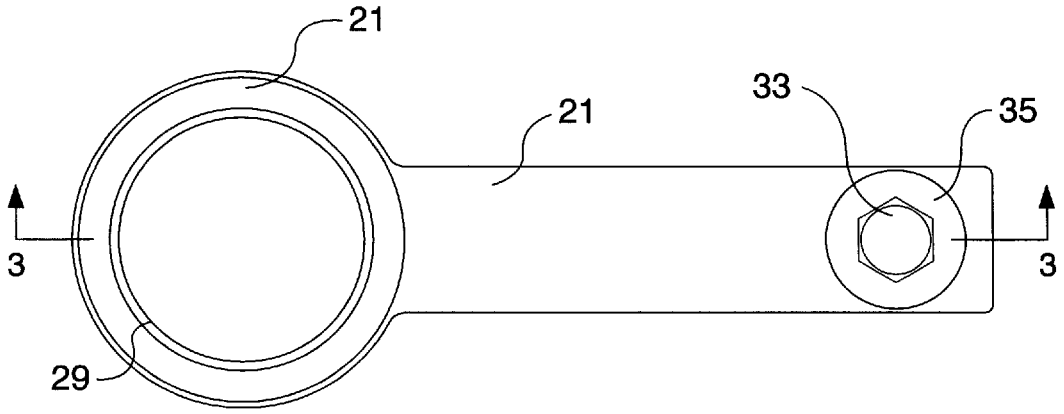
FIG. 2 is an enlarged top view of the jump tube.
Figures 3, 4:
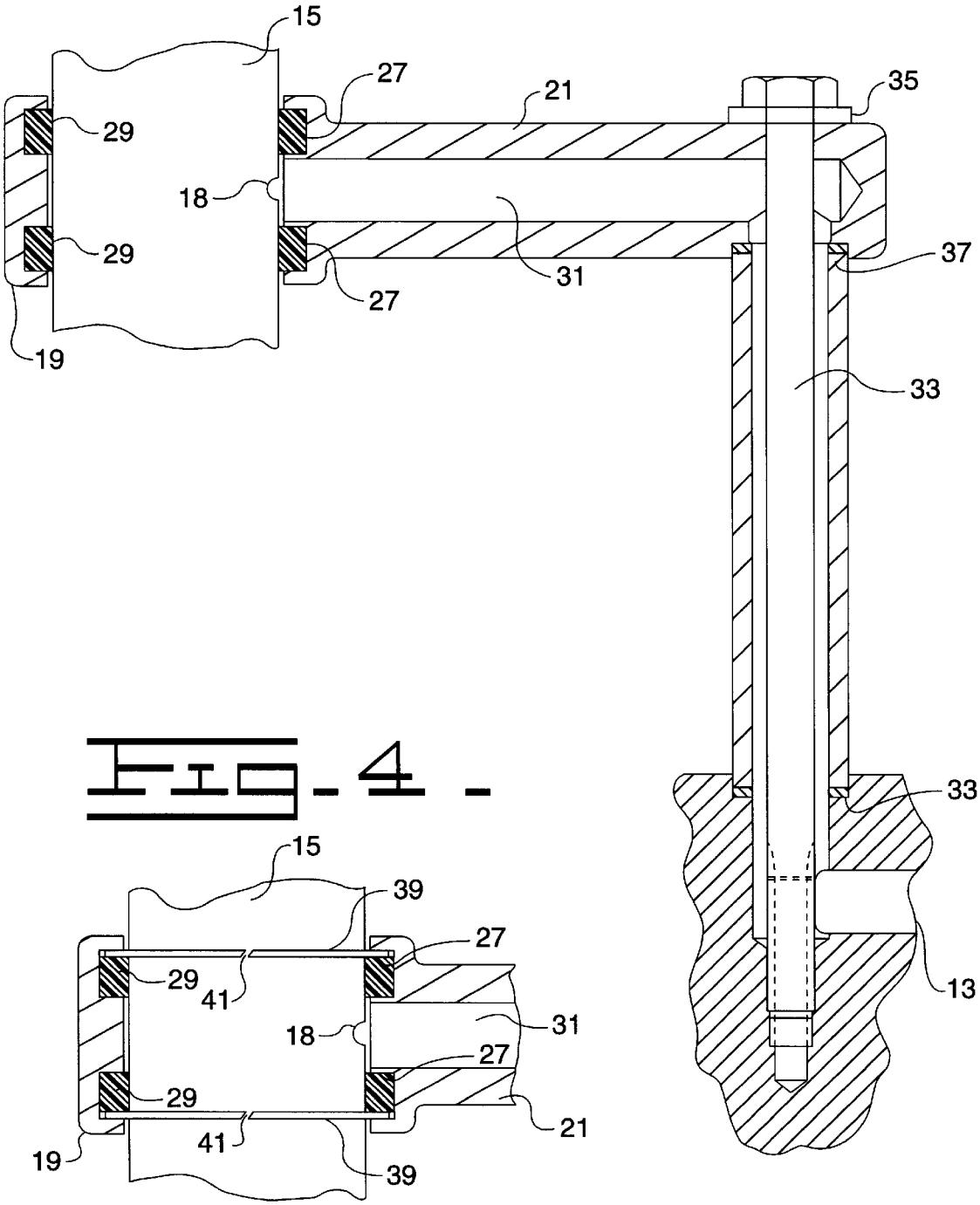
FIG. 3 is an enlarged sectional view of the jump tube and a portion of a head showing an actuating fluid supply manifold taken on line 3—3 of FIG. 2.
FIG. 4 is an enlarged partial sectional view of a receiver portion of the jump tube.

Referring now to FIGS. 2 and 3 the jumper tube 17 comprises a receiver portion 19, a tubular portion 21 and a conduit portion 23. Preferably the receiver and tubular portions 19 and 21 are part of an integral casting, however they may be made separately.

The receiver portion 19 is generally cylindrically shaped and has a central bore 25 which is slightly larger in diameter than the outer diameter of the injector 15. An annular groove 27 is disposed in the bore 25 adjacent each end. A resilient seal ring 29 is disposed in each annular groove 27 forming seals between the injector 15 and the bore 25 and allowing three degrees of freedom between the bore 25 and the injector 15. Thus eliminating any distortion of the injector 15 due to misalignment. The injector 15 has moving parts with close tolerances that move rapidly in high pressure surroundings and slight distortions may cause malfunction of the injector 15.

The tubular portion 21 may have a rectangular or circular cross section with an elongate central passage 31 that opens into the bore 25.

The conduit portion 23 provides fluid communication between the activating fluid supply manifold 13 and the central passage 31. A bolt 33 passes through a seal ring 35 above the tubular portion 21, through the tubular portion 21, through the conduit portion 21 and through a portion of the activating fluid manifold 13 and is threaded into the head 11 removably attaching the jumper tube 17 to the head 11. There is sufficient clearance around the bolt 33 to allow free flow of the activating fluid. Seal rings 37 are disposed on the both ends of the conduit 23 and cooperate with the bolt 33 to form a liquid tight seal where the ends of the conduit portion 23 abuts the tubular portion 21 and the head 11.

Referring now to FIG. 4, there is shown a retainer or backup ring 39 disposed in each of the annular grooves 27 along with the resilient seal rings 29. The retainer rings 39 fit tightly against the injector 15. The retainer rings 39 each have a tapered overlapping split 41 in order not to distort the injector 15 and allow the retainer rings 39 to contact the injector 15. The retainer rings 39 would only be utilized if the activating pressure is extremely high and the retainer rings 39 are needed to prevent the resilient seal rings from being extruded through the clearance between the bore 25 and the injector 15 by the extremely high actuating pressure.

While the preferred embodiments described herein set forth the best mode to practice this invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

Industrial Applicability

A jumper tube, when made in accordance with this invention, advantageously provides fluid communication between an activating fluid manifold and an injector which is easy to install and remove and provides three degrees of freedom so that misalignment of the injector will not cause distortion and malfunction of the injector.

What is claimed is:

1. A jumper tube for an electronically controlled hydraulically operated unit fuel injector having an activating fluid inlet port and is disposed in a head of an internal combustion engine to inject fuel into an associated cylinder;

an activating fluid supply manifold is also disposed in the head; the jumper tube comprises a receiver portion comprising a cylindrical portion that contains a central bore which receives the injector, an annular groove adjacent each end of the bore, a resilient seal ring is so disposed in each of the annular grooves to form a seal adjacent each end of the bore between the injector and the bore and to allow three degrees of freedom between the receiver portion and the injector a tubular portion is made integral with the cylindrical portion and is disposed in fluid communication with the bore in board of the annular grooves, a conduit connected to the tubular portion and providing fluid communication between the tubular portion and the supply manifold, a bolt that passes through the tubular portion, through the conduit, through a portion of the supply manifold and is threaded into the head to attach the jumper tube to the head; there being clearance between the bolt and the conduit and tubular portion, placing the activating fluid inlet port of the injector in fluid communication with the activating fluid supply manifold; eliminating any distortion of the injector due to misalignment, and the conduit providing fluid communication between the inlet port of the injector, the bore and the activating fluid supply manifold.

2. The jumper tube as set forth in claim 1, further comprising a backup ring disposed in each annular groove with the resilient seal ring to prevent the resilient seal ring from being extruded through the clearance between the bore and the injector.

3. The jumper tube as set forth in claim 1, further comprising a backup ring disposed in each annular groove with the resilient seal ring to prevent the resilient seal ring from being extruded through the clearance between the bore and the injector.

4. A jumper tube for an electronically controlled hydraulically operated unit fuel injector having an activating fluid inlet port and is disposed in a head of an internal combustion engine to inject fuel into an associated cylinder; and activating fluid supply manifold is also disposed in the head; the jumper tube comprises a receiver portion comprising a cylindrical portion that contains a central bore which receives the injector, an annular groove adjacent each end of the bore, a resilient seal ring is so disposed in each of the annular grooves to form a seal adjacent each end of the bore between the injector and the bore and to allow three degrees of freedom between the receiver portion and the injector, a tubular portion disposed in fluid communication with the bore in board of the annular grooves, a conduit connected to the tubular portion and providing fluid communication between the tubular portion and the supply manifold, a bolt that passes through the tubular portion, through the conduit, through a portion of the supply manifold and is threaded into the head to attach the jumper tube to the head; there being clearance between the bolt and the conduit and tubular portion, placing the activating fluid inlet port of the injector in fluid communication with the activating fluid supply manifold; eliminating any distortion of the injector due to misalignment, and the conduit providing fluid communication between the inlet port of the injector, the bore and the activating fluid supply manifold.

* * * * *